US005992484A

United States Patent [19]

Jackson

[11] Patent Number: 5,992,484

[45] Date of Patent: Nov. 30, 1999

[54] METHOD AND APPARATUS FOR POSITIONING FLITCHES OR CANTS FOR A BOARD EDGER OR GANG SAW

[75] Inventor: James Jackson, Salmon Arm, Canada

[73] Assignee: CAE Electronics Ltd. CAE Electronique Ltee, St. Laurent, Canada

[21] Appl. No.: 09/021,483

[22] Filed: Feb. 10, 1998

Related U.S. Application Data

[60] Provisional application No. 60/037,543, Feb. 11, 1997.

[51] Int. Cl.[6] ..... B27B 1/00

[52] U.S. Cl. ..... 144/245.1; 144/242.1; 144/245.2; 144/246.1; 144/382; 144/357; 198/341; 198/456; 198/457; 198/572

[58] Field of Search ..... 144/242.1, 245.1, 144/245.2, 246.1, 356, 357, 382; 198/341, 434, 456, 457, 572, 345.1

[56] References Cited

U.S. PATENT DOCUMENTS

| | | | |
|---|---|---|---|
| 3,970,128 | 7/1976 | Kohlberg | 144/245.2 |
| 4,383,561 | 5/1983 | Gregoire et al. | 144/245.2 |
| 4,386,641 | 6/1983 | Horn | 144/329 |
| 4,413,662 | 11/1983 | Gregoire et al. | 144/356 |
| 4,462,443 | 7/1984 | Allen | 144/242.1 |
| 5,115,846 | 5/1992 | Miller et al. | 144/246.1 |
| 5,201,354 | 4/1993 | Weissbeck | 144/245.2 |
| 5,368,080 | 11/1994 | Hamel | 144/357 |
| 5,381,712 | 1/1995 | Head, Jr. et al. | 83/418 |
| 5,417,265 | 5/1995 | Davenport et al. | 144/376 |
| 5,518,052 | 5/1996 | Westberg et al. | 144/398 |

*Primary Examiner*—W. Donald Bray
*Attorney, Agent, or Firm*—Antony C. Edwards

[57] ABSTRACT

A workpiece positioning device for translating elongate workpieces conveyed on a first workpiece conveyor in a conveyance direction and for positioning the elongate workpieces on an adjacent second workpiece conveyor, wherein the elongate workpieces are generally laterally aligned across the first workpiece conveyor, generally perpendicular to the conveyance direction, has a selectively actuable rotatable member extending between the first and second workpiece conveyors, rotatable so as to translate workpiece engaging means, coordinated by coordinating means, into engagement with an elongate workpiece at a workpiece engaging position on the first workpiece conveyor generally at an end of the first workpiece conveyor adjacent the second workpiece conveyor, and to translate the workpiece engaging means and the elongate workpiece so engaged from the first workpiece conveyor to the second workpiece conveyor so as to position the elongate workpiece on the second workpiece conveyor.

6 Claims, 5 Drawing Sheets

METHOD AND APPARATUS FOR POSITIONING FLITCHES OR CANTS FOR A BOARD EDGER OR GANG SAW

CROSS REFERENCE TO RELATED APPLICATION

This application claims priority from United States Provisional Patent Application Ser. No. 60/037,543 filed Feb. 11, 1997 titled The Method and Apparatus for Positioning Flitches or Cants for a Board Edger or Gang Saw.

FIELD OF THE INVENTION

This invention relates to a method and apparatus for positioning a flitch or a cant, and in particular relates to a positioning system for the placement of a flitch or a cant onto bed rolls, a sharp chain, a belt conveyor, or other feed mechanism, for lineal feeding to an edger or gang saw.

BACKGROUND OF THE INVENTION

Previously, most positioning tables of the general type, have overhead or underneath positioners that reach out and grasp the flitch or cant (hereinafter referred to as the workpiece) and then pull the workpiece onto the feed line.

It is therefore an object of the invention to produce an apparatus that requires less parts and improves the cycle speed of the positioning of the workpiece.

SUMMARY OF THE INVENTION

The apparatus of the present invention for positioning flitches or cants for a board edger or gang saw, is fed by using a sequencing transfer table with a plurality of rows of duckers, that are rotated up into the path of the workpiece, so as to hold the workpiece for timed release, and then rotated down out of the path of the workpiece. The workpiece, once released, advances up to a row of park zone pin stops. The pin stops hold the workpiece in position for pick up by a plurality of rotary positioning platforms. The rotary positioning platforms are rotated up under the workpiece. The workpiece is picked up on the rotating platforms as the platforms rotate, positioning the workpiece onto the bed rolls for feeding into the saws. The platforms are maintained generally horizontal as the platforms rotate. The apparatus may incorporate adjustable positioning pin stops so as to skew the workpiece if necessary, depending on whether the scanner is before, or after the positioning table. At least two rotary positioning platforms are advisable, spaced apart along the length of the workpiece, depending on the length of the workpiece. A driven infeed press roll, just outside of the lumber line on the positioning table, ensures rapid feeding of the workpiece once the workpiece has been placed by the rotary positioning platforms and advanced past the lumber line.

In an alternative embodiment, the rotary positioning platforms are replaced with short segments of circulating lugged chains. Pivotable lugs are attached to the lugged chain segments by a pivot pin which allows the lugs to drop (i.e. rotate) backward below the top of the chain once the lugs have passed over a chainway. The chainway engages the lugs and pivots them to the upright and maintains the lugs upright while the lugs push the workpiece onto the bed rolls. The chainways can be adjusted independently, so as to allow the lug to fall back in a different place in respect to other lugs so as to skew the workpiece if needed, depending on whether the scanner is before, or after the positioning table.

In summary, the workpiece positioning device of the present invention, for translating elongate workpieces conveyed on a first workpiece conveyor in a conveyance direction and positioning said elongate workpieces on an adjacent second workpiece conveyor, wherein said elongate workpieces are generally laterally aligned across said first workpiece conveyor, generally perpendicular to said conveyance direction, comprises a selectively actuable rotatable member extending between said first and second workpiece conveyors, rotatable so as to translate workpiece engaging means, coordinated by coordinating means, into engagement with an elongate workpiece at a workpiece engaging position on said first workpiece conveyor generally at an end of said first workpiece conveyor adjacent said second workpiece conveyor, and to translate said workpiece engaging means and said elongate workpiece so engaged from said first workpiece conveyor to said second workpiece conveyor so as to position said elongate workpiece on said second workpiece conveyor.

Advantageously, said rotatable member is rotatable in a generally vertical plane parallel to said conveyance direction, and said workpiece engaging means are pivotable relative to said rotatable member so as to be pivotable into a workpiece engaging orientation at said workpiece engaging position.

In one aspect of the present invention, said rotatable member is a selectively actuable rotatable framework, member, or like transport medium rotatable relative to said first workpiece conveyor and having said workpiece engaging means at a distal end of said rotatable framework, wherein said workpiece engaging means is pivotable relative to said rotatable framework according to the operation of said coordinating means, said coordinating means for coordinating orientation of said workpiece engaging means between a workpiece engaging orientation, a workpiece translating orientation and a workpiece depositing orientation at said workpiece engaging position, during translation of said elongate workpiece from said workpiece engaging position, and at a workpiece deposit position on said second workpiece conveyor respectively.

Advantageously, said rotatable framework is a rigid member, or a rotatable linkage of rigid members, and said coordinating means is a timing chain, belt or the like coordinating said orientation of said workpiece engaging means relative to said rigid member or members, wherein said workpiece engaging means is a second rigid member, arm, beam or platform or the like, or said coordinating means is a coordinated, spaced-apart pivotally linked arrangement of said rotatable linkage or rigid members.

Further advantageously, said workpiece positioning device comprises a laterally spaced apart array of said selectively actuable rotatable members, corresponding said workpiece engaging means, and corresponding said coordinating means, spaced apart laterally across said first workpiece conveyor between said first and second workpiece conveyors.

In a second aspect of the present invention, said rotatable member is a selectively actuable rotatable flexible linkage, chain, belt, or like transport medium rotatably mounted in a continuous loop about spaced apart fixedly mounted first and second rotation means such as sprockets, pulleys or the like, spaced apart so as to extend said rotatable member between said first and second workpiece conveyors, said workpiece engaging means is a lug member, arm, plate, hook, or the like, pivotally mounted at one end thereof to said rotatable member so as to be pivotable into a generally upright position extending into a workpiece feedpath on said first workpiece conveyor and translating in said feedpath in said conveyance direction, pivotable upon biasing of said workpiece engaging means by said coordinating means, wherein said coordinating means is a biasing member such as a chainway, or array of biasing members, having a biasing length corresponding to a workpiece translating path between said workpiece engaging position and a workpiece deposit position on said second workpiece conveyor.

Advantageously, said biasing member or members lie in a plane generally coplanar with, or adjacently below and parallel with, a plane containing biasing member engaging surfaces on said workpiece engaging means when said workpiece engaging means are translated on said rotatable member into adjacency with said workpiece translation path on said first workpiece conveyor.

BRIEF DESCRIPTION OF THE DRAWINGS

The invention will be better understood by reference to drawings, wherein.

DETAILED DESCRIPTION OF THE PREFERRED EMBODIMENT

Figure 1:
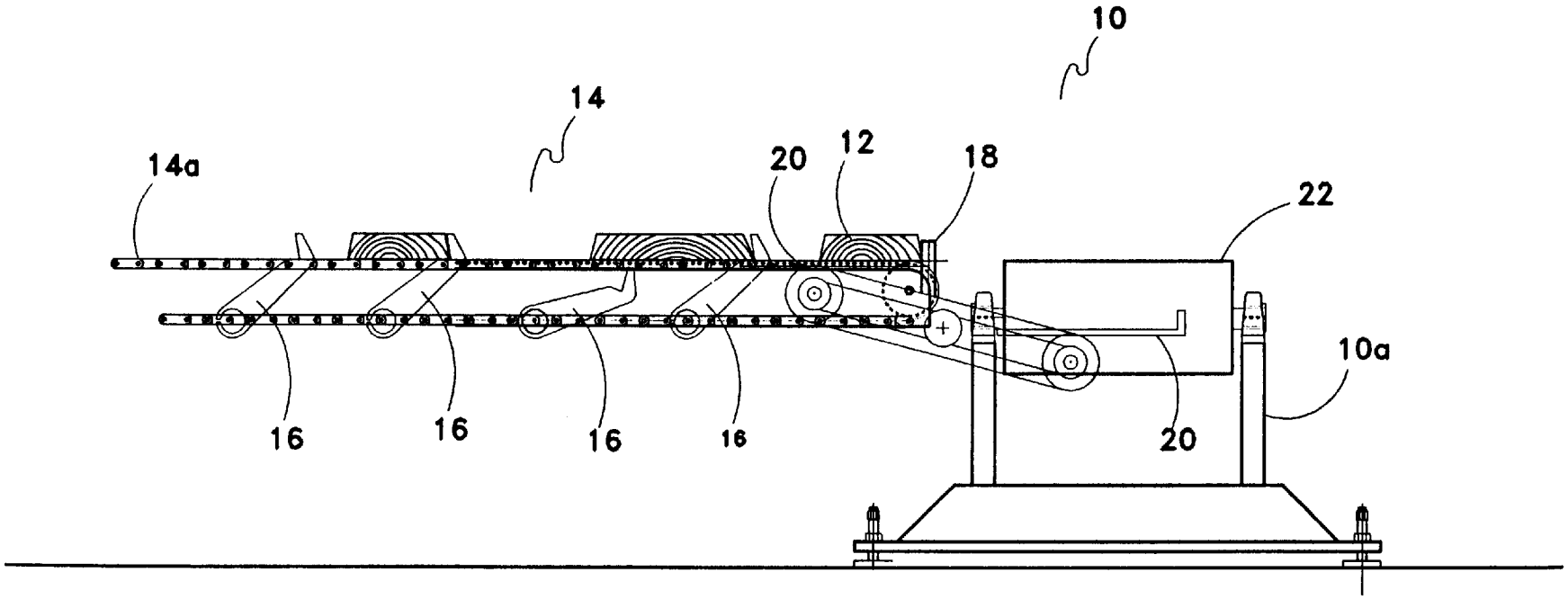
FIG. 1 is a side elevation view according to a preferred embodiment of the invention, showing the rotary positioning platforms, under the workpiece about to lift the workpiece up over the pin stops.

Referring to the drawing figures wherein similar characters of reference represent corresponding parts in each view, an edger infeed positioning table is generally indicated by the reference numeral 10 and is best seen in FIG. 1.

Figure 2:
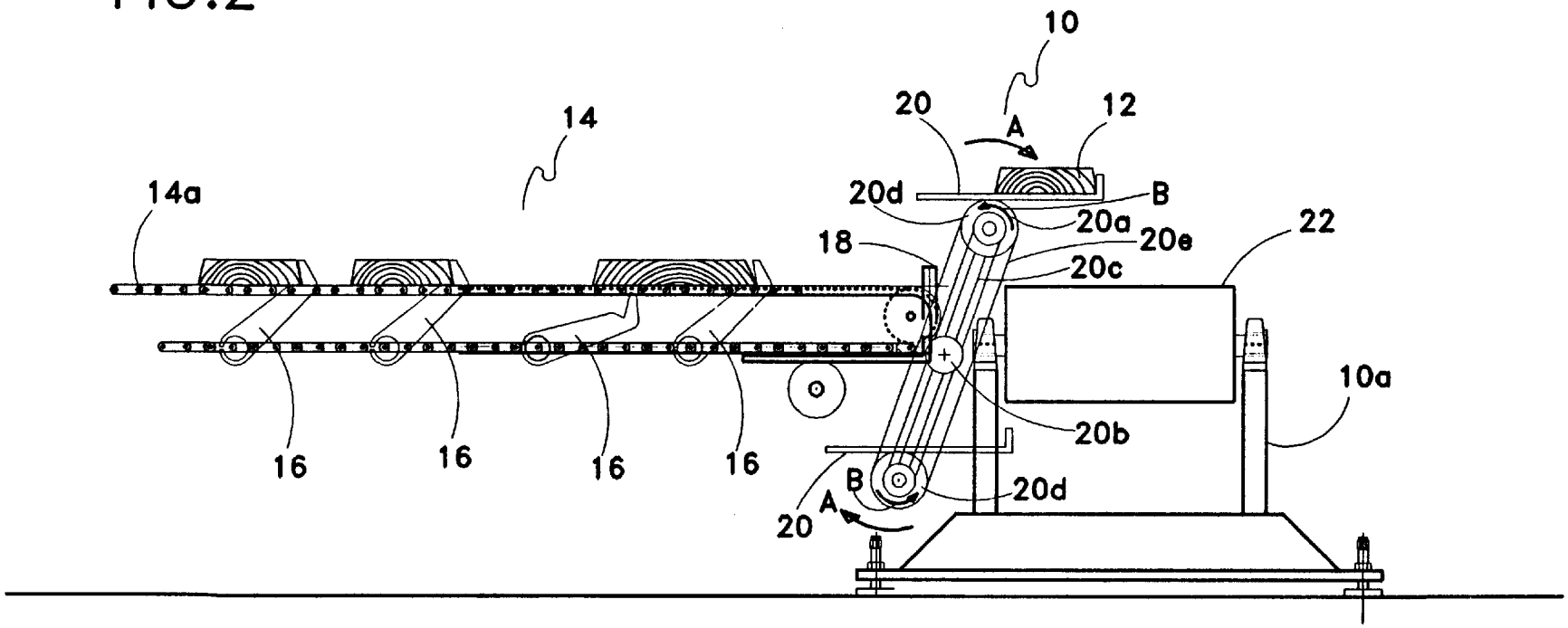
FIG. 2 is a side elevation view according to a preferred embodiment of the invention, showing the rotary positioning platforms rotating up and carrying the workpiece up over the pin stops.
Figure 3:
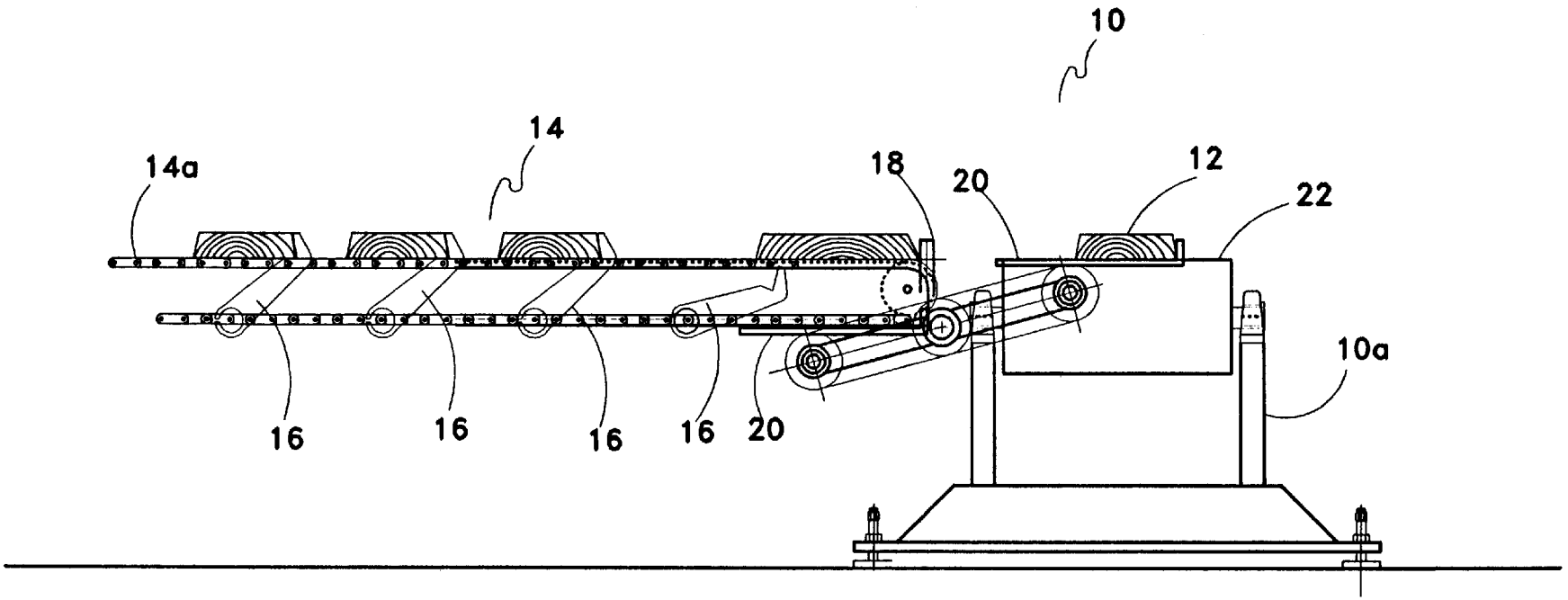
FIG. 3 is a side elevation view according to a preferred embodiment of the invention, showing the rotary positioning platforms, placing the workpiece on to the feed line.

Workpiece 12 is fed onto a sequencing transfer 14, where sequencing transfer 14 includes sequencing transfer chains 14*a* and sequencing duckers 16. Positioning table 10 has a support frame 10*a*. A laterally spaced apart row of park zone pin stops 18 precede positioning table 10. The positioning table 10 includes a plurality or spaced apart array of rotary positioning platforms 20, for lifting and moving the workpiece 12 over park zone pins 18 and onto the bed rolls 22. The rotary positioning platforms 20 include a levelling device, generally designated as 20*a* (see FIG. 2), that rotate in cooperation with platforms 20 so that as platforms 20 are rotated up to move the workpiece 12 from the park zone pins 18, up and over to place the workpiece 12 15 onto the bed rolls 22, workpiece 12 is kept level. After the workpiece 12 has been placed onto bed rolls 22, a driven press roll (not shown), just outside of the lumberline, is actuated to press down onto workpiece 12 to ensure traction on, and thus the speed of, workpiece 12 as the bed rolls 22 are activated to begin feeding the workpiece 12.

In operation, when it is desired to actuate platforms 20 so as to transfer workpieces 12 from behind park pins 18 onto bed rolls 22, support frame 20*c* is rotated in direction. A relative to fixed sprocket 20*b*. Fixed sprocket 20*b* is fixed in relation to frame 10*a*. Support frame 20*c* supports at its ends axle-mounted rotatable sprockets 20*d*. Sprockets 20*d* are rotated relative to support frame 20*c* by chain 20*e*. Chain 20*e* is wrapped in a continuous loop around, in toothed engagement with, sprockets 20*d*. Chain 20*e* extends between sprockets 20*d* and mates, in toothed engagement with, fixed sprocket 20*b*. As support frame 20*c* is rotated in direction A, sprockets 20*d* are rotated in direction B by the action of chain 20*e*. Platforms 20 are mounted in fixed horizontal relation to sprockets 20*d*. Platforms 20 thus remain level as support frame 20*c* and sprockets 20*d* are rotated.

Figure 4:
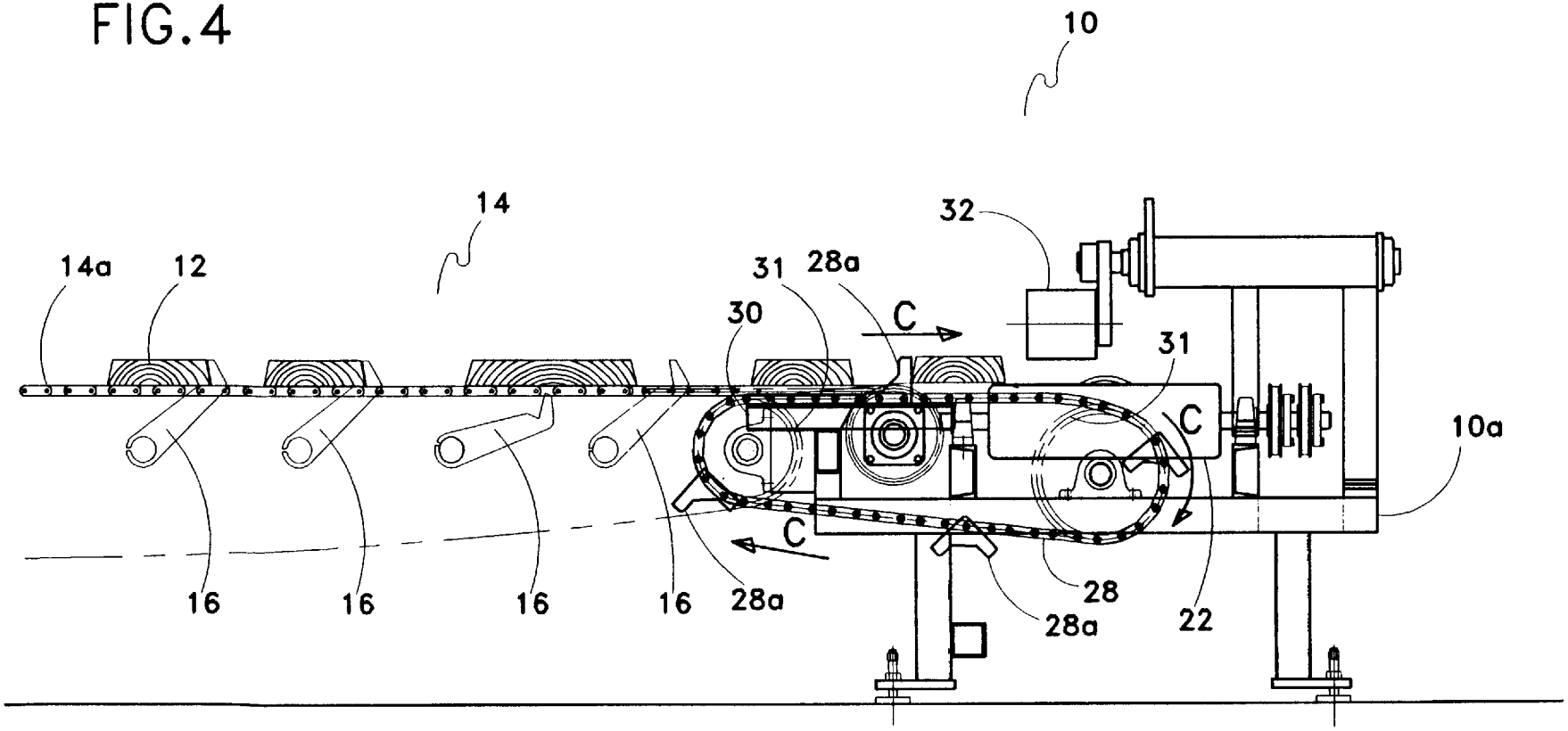
FIG. 4 is a side elevation view according to an alternative embodiment of the invention, showing the short segments of circulating lugged chains pushing the workpiece on to the feed rolls.
Figure 5:
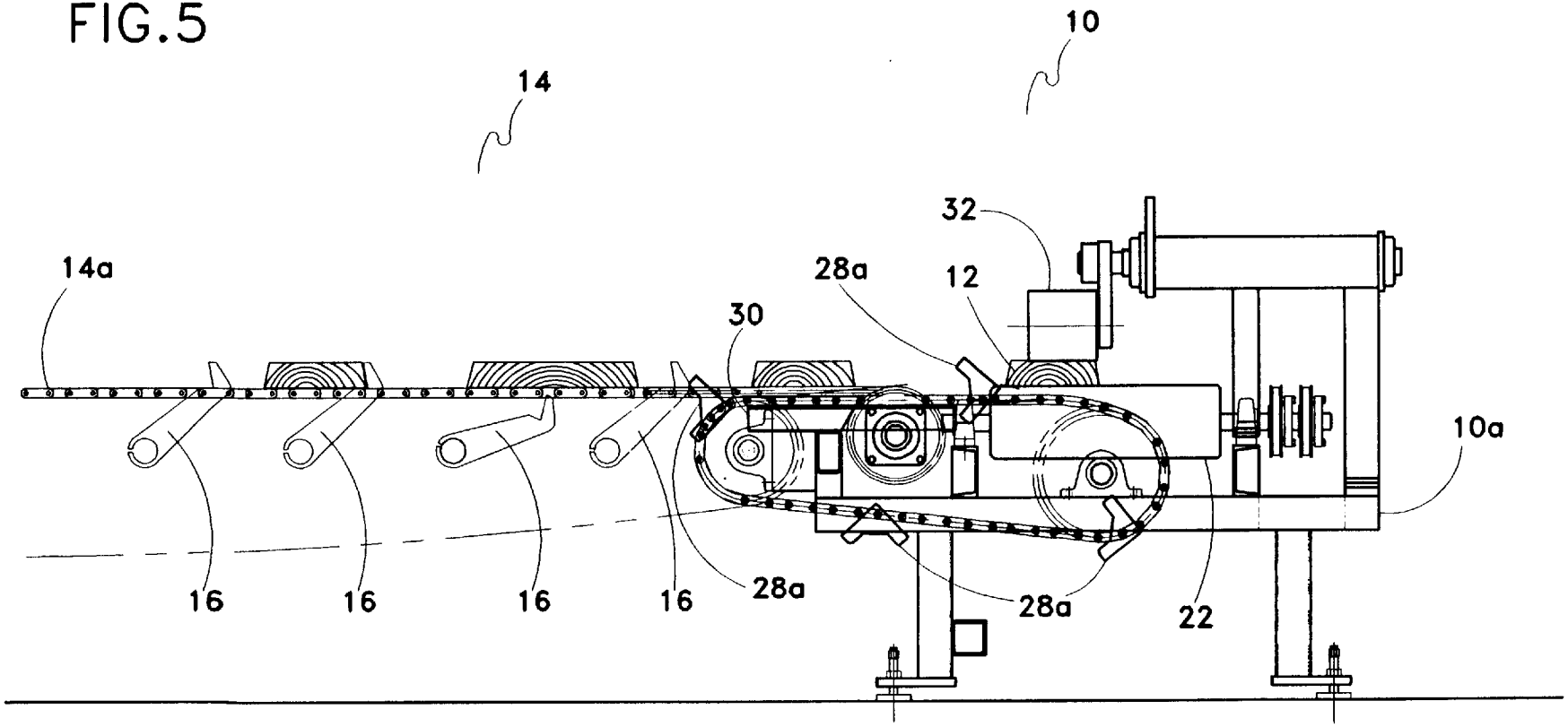
FIG. 5 is a side elevation view according to a preferred embodiment of the invention, showing the short segments of circulating lugged chains having pushed the workpiece on to the feed rolls and falling back to circulate under the feed rolls.

In an alternative embodiment, as best seen in FIG. 4 and FIG. 5, positioners are provided in the form of a laterally spaced apart array of short segments of circulating lugged chains 28, having rotatable lugs 28*a* pivotally mounted thereto. Lugs 28*a* are translated along chainways 30 as lugged chains 28 are rotated in direction C about sprockets 31. Lugs 28*a,* which are free to rotate relative to lugged chains 28, and so normally hang down under the force of gravity, engage chainway 30 and are thereby rotated into an upright position so as to protrude above the upper surface of transfer chains 14*a*. When so engaged in chainway 30, so as to protrude above the upper surface of transfer chains 14*a*, lugs 28*a* engage workpieces 12 resting on the transfer table onto which they have been deposited by transfer chain 14*a*. Once engaged by lugs 28*a,* workpieces 12 are also translated in direction C until a workpiece 12 reaches bed rolls 22, where lugs 28*a* reach the end of chainways 30. Once lugs 28*a* pass the ends of chainways 30, lugs 28*a* rotate freely backwards and downwards, thus leaving the workpiece 12 positioned on the bed rolls 22. A plurality of driven overhead press rolls 32 are actuated to press workpiece 12 down onto bed rolls 22, for feeding into the saws (not shown).

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A workpiece positioning device for translating elongate workpieces conveyed on a first workpiece conveyor in a conveyance direction and for positioning said elongate workpieces on an adjacent second workpiece conveyor, wherein said elongate workpieces arc generally laterally aligned across said first workpiece conveyor, generally perpendicular to said conveyance direction, comprising a selectively actuable rotatable carrier extending for rotation between said first and second workpiece conveyors, a workpiece engaging member pivotally mounted on said rotatable carrier, said rotatable carrier rotatable so as to translate said workpiece engaging member into engagement with an elongate workpiece at a workpiece engaging position on said first workpiece conveyor generally at an end of said first workpiece conveyor adjacent said second workpiece conveyor, and to translate said workpiece engaging member and said elongate workpiece so engaged from said first workpiece conveyor to said second workpiece conveyor so as to position said elongate workpiece on said second workpiece conveyor so as to position said elongate between a workpiece engaging orientation at said workpiece engaging position and a workpiece depositing orientation when positioning said workpiece engaging position and a conveyor by a workpiece engaging member orientation coordinator.

2. The device of claim 1 wherein said rotatable carrier is rotatable in a generally vertical plane parallel to said conveyance direction, and said workpiece engaging member is pivotable relative to said rotatable carrier so as to be pivotable into said workpiece engaging orientation at said workpiece engaging position.

3. The device of claim 2 wherein said rotatable carrier is a selectively actuable rotatable framework rotatable relative to said first workpiece conveyor and having said workpiece engaging member at a distal end of said rotatable framework, wherein said workpiece engaging member is pivotable relative to said rotatable framework according to operation of said coordinator, said coordinator for coordinating orientation of said workpiece engaging member between said workpiece engaging orientation, a workpiece translating orientation and said workpiece depositing orientation respectively at said workpiece engaging position, during translation of said elongate workpiece from said workpiece engaging position, and at a workpiece deposit position on said second workpiece conveyor.

4. The device of claim 3 wherein said coordinator is a timing chain coordinating said orientation of said workpiece engaging member relative to said rotatable framework, wherein said rotatable carrier is a rigid member and wherein said workpiece engaging member is a second rigid member.

5. The device of claim 1 wherein said rotatable carrier is a selectively actuable rotatable flexible linkage rotatably mounted in a continuous loop about spaced apart first and second rotation means, spaced apart so as to extend said rotatable carrier between said first and second workpiece conveyors, and wherein said workpiece engaging member is at least one lug member, pivotally mounted at one end of said lug member to said linkage, so as to be pivotable into a generally upright position extending into a workpiece feedpath on said first workpiece conveyor and translating in said feedpath in said conveyance direction, said lug member pivotable upon biasing by said coordinator, wherein said coordinator is a biasing member having a biasing length corresponding to a workpiece translating path between said workpiece engaging position and a workpiece deposit position on said second workpiece conveyor.

6. The device of claim 5 wherein said biasing member lies in a plane generally coplanar with a plane containing biasing member engaging surfaces on said at least one lug member when said at least one lug member is translated on said linkage into adjacency with said workpiece translation path.

* * * * *